US006793685B2

(12) United States Patent
Noyes et al.

(10) Patent No.: US 6,793,685 B2
(45) Date of Patent: Sep. 21, 2004

(54) METHODS FOR PARTICULATE REMOVAL FROM FABRICS

(75) Inventors: Anna Vadimovna Noyes, Hamilton, OH (US); Arseni V. Radomyselski, Hamilton, OH (US); John Cort Severns, West Chester, OH (US); Paul Amaat France, West Chester, OH (US)

(73) Assignee: PRocter & Gamble Company, Cincinnati, OH (US)

( * ) Notice: Subject to any disclaimer, the term of this patent is extended or adjusted under 35 U.S.C. 154(b) by 115 days.

(21) Appl. No.: 10/385,392

(22) Filed: Mar. 10, 2003

(65) Prior Publication Data

US 2003/0167576 A1 Sep. 11, 2003

Related U.S. Application Data

(62) Division of application No. 09/824,605, filed on Apr. 2, 2001, now Pat. No. 6,564,591.

(60) Provisional application No. 60/219,882, filed on Jul. 21, 2000.

(51) Int. Cl.[7] ..... D06B 1/02

(52) U.S. Cl. ..... 8/149.2; 8/142

(58) Field of Search ..... 8/142, 149.2, 147; 68/5 C; 34/250, 130

(56) References Cited

U.S. PATENT DOCUMENTS

| | | | | |
|---|---|---|---|---|
| 3,543,408 A | * | 12/1970 | Candor et al. | 34/250 |
| 4,097,397 A | | 6/1978 | Mizutani et al. | |
| 4,102,824 A | | 7/1978 | Mizutani et al. | |
| 4,236,320 A | * | 12/1980 | Schwadike et al. | 34/428 |
| 4,267,077 A | | 5/1981 | Niimi et al. | |
| 4,708,807 A | | 11/1987 | Kemerer | |
| 4,909,962 A | | 3/1990 | Clark | |
| 5,037,485 A | | 8/1991 | Chromecek et al. | |
| 5,116,426 A | | 5/1992 | Asano et al. | |
| 5,271,775 A | | 12/1993 | Asano et al. | |
| 5,302,313 A | | 4/1994 | Asano et al. | |
| 5,360,571 A | | 11/1994 | Kilgour et al. | |
| 5,443,747 A | | 8/1995 | Inada et al. | |
| 5,503,681 A | | 4/1996 | Inada et al. | |
| 5,503,778 A | | 4/1996 | Liu et al. | |
| 5,520,827 A | | 5/1996 | Danner | |
| 5,593,507 A | | 1/1997 | Inada et al. | |
| 5,597,792 A | | 1/1997 | Klier et al. | |

(List continued on next page.)

*Primary Examiner*—Randy Gulakowski
*Assistant Examiner*—Joseph L Perrin
(74) *Attorney, Agent, or Firm*—C. Brant Cook; Caroline Wei-Berk; Kim W. Zerby

(57) ABSTRACT

The present invention relates to devices and processes for removing particulate soil from fabric articles, especially articles of clothing, linen and drapery.

23 Claims, 11 Drawing Sheets

U.S. PATENT DOCUMENTS 5,628,883 A 5/1997 Sugiyama et al.
5,651,276 A * 7/1997 Purer et al. ..... 68/5 C
5,676,705 A 10/1997 Jureller et al.
5,683,473 A 11/1997 Jureller et al.
5,683,977 A 11/1997 Jureller et al.
5,690,750 A 11/1997 Inada et al.
5,705,562 A 1/1998 Hill
5,707,613 A 1/1998 Hill
5,716,456 A 2/1998 Inada et al.
5,722,781 A 3/1998 Yamaguchi
5,741,365 A 4/1998 Inada et al.
5,769,962 A 6/1998 Inada et al.
5,783,092 A 7/1998 Brown et al.
5,802,884 A * 9/1998 Cavalli ..... 68/18 C
5,811,383 A 9/1998 Klier et al.
5,829,275 A 11/1998 Babuin et al.
5,858,022 A 1/1999 Romack et al.
5,865,852 A 2/1999 Berndt
5,866,005 A 2/1999 DeSimone et al.
5,876,510 A 3/1999 Kuemin et al.
5,877,133 A 3/1999 Good
5,888,250 A 3/1999 Hayday et al.
5,929,012 A 7/1999 Del Duca et al.
5,942,007 A 8/1999 Berndt et al.
5,944,996 A 8/1999 DeSimone et al.
5,954,869 A 9/1999 Elfersy et al.
5,977,040 A 11/1999 Inada et al.
5,977,045 A 11/1999 Murphy
5,985,810 A 11/1999 Inada et al.
6,013,683 A 1/2000 Hill et al.
6,042,617 A 3/2000 Berndt
6,042,618 A 3/2000 Berndt et al.
6,056,789 A 5/2000 Berndt et al.
6,059,845 A 5/2000 Berndt et al.
6,060,546 A 5/2000 Powell et al.
6,063,135 A 5/2000 Berndt et al.
6,086,635 A 7/2000 Berndt et al.
6,114,295 A 9/2000 Murphy
6,131,421 A 10/2000 Jureller et al.
6,136,766 A 10/2000 Inada et al.
6,148,644 A 11/2000 Jureller et al.
6,156,074 A 12/2000 Hayday et al.
6,177,399 B1 1/2001 Mei et al.
6,200,352 B1 3/2001 Romack et al.
6,200,393 B1 3/2001 Romack et al.
6,200,943 B1 3/2001 Romack et al.
6,204,233 B1 3/2001 Smith et al.
6,228,826 B1 5/2001 DeYoung et al.
6,242,408 B1 6/2001 Elms et al.
6,346,126 B1 * 2/2002 Chao et al. ..... 8/149.2

* cited by examiner

METHODS FOR PARTICULATE REMOVAL FROM FABRICS

CROSS REFERENCE TO RELATED APPLICATIONS

This application is claims priority to and is a divisional of U.S. Ser. No. 09/824,605 filed Apr. 2, 2001, now U.S. Pat. No. 6,564,591, which claims priority under 37 U.S.C. § 119(e) to U.S. Provisional Application Ser. No. 60/219,882, filed Jul. 21, 2000.

FIELD OF THE INVENTION

The present invention generally relates to devices and processes for removing particulate soil from fabric articles, especially articles of clothing, linen and drapery.

BACKGROUND OF THE INVENTION

There are two types of cleaning systems that are available to consumers today, namely, conventional laundry or dry cleaning. Frequently, consumers are dealing with the problem of washing garments that are heavily contaminated with large, dry particulates such as cat fur, hair, dust, clay, dried mud, etc. By putting these garments into the washer "as is" and submitting them to regular washing process, these soils become even more difficult to remove. While removal of these particulates can be obtained by pre-treating each soiled area this process labor intensive time consuming and the ever present fear of insufficiently treating the soil or missing it altogether remains.

Neither of these systems is convenient for the consumer to use. For example, neither system provides a way to remove cat hair from an otherwise clean article. Taking the article to the dry cleaner would not be cost efficient for a single item, which in any event, may not be ready in time for the consumers needs. Throwing the article into the washer at home would mean several hours before the hair was removed and the article dried in the dryer. The final alternative of the consumer removing each hair by hand is seemingly as efficient a use of the consumer's time as the other two.

Accordingly, there remains a need in the art for a process and apparatus for removing particulate soil from fabric articles, in a fashion that is readily accessible to the consumer and uses the minimum time necessary.

SUMMARY OF THE INVENTION

It has now surprisingly been found that there does exist an apparatus and process for removing particulate soil from discrete fabric articles that is readily accessible to the consumer and uses the minimum time necessary. Furthermore, the apparatus and process suffer none of the disadvantages of the conventional laundry or dry cleaning systems with respect to particulate soil.

Large particulates such as cat fur, human hair, clay etc. can be successfully removed using gas flow prior to a washing process. This may be viewed as a first step in the washing process, completely free of water or other liquids. By implementing this step it decreases the "demand" on chemicals in the wash by removing these soils prior to wetting. Alternatively, this process may be used as a stand alone process with no further cleaning of the treated garment. This would allow for cleaning or refreshing of a garment that has only been soiled with, for example, pet hair.

In accordance with a first aspect of the present invention, a method for removing particulate soil from discrete fabric articles is provided. The method comprises at least the steps of:

(a) placing substantially dry fabric articles in a walled vessel;

(b) adding a gas to the vessel wherein the gas is added to the vessel at a rate of from about 10 l/s to about 70 l/s and the gas enters the vessel with a velocity of from about 1 m/s to about 155 m/s;

(c) concurrently with (b), mechanically agitating the fabric while the gas impinges on soiled areas of the fabric; and (d) concurrently with (b) and (c) removing the gas from the vessel at a rate sufficient to prevent the removed soil from re-depositing upon the fabric;

In accordance with a second aspect of the present invention, an apparatus for removing particulate soil from discrete fabric articles by mechanically agitating the fabric while gas impinges on soiled areas of the fabric is provided. The apparatus comprises a rotary drum driven by an electric motor under the control of a control means, at least one gas inlet, wherein the gas inlet has a muzzle diameter sufficient to provide gas to the apparatus at a rate of from about 10 l/s to about 70 l/s and a muzzle velocity of from about 1 m/s to about 155 m/s and at least one gas outlet, wherein the gas outlet is of sufficient diameter to prevent the removed soil from re-depositing upon the fabric.

In accordance with a third aspect of the present invention, a method for removing particulate soil from discrete fabric articles is provided. The method comprises at least the steps of:

(a) placing substantially dry fabric articles in a walled vessel;

(b) adding a gas to the vessel through at least one first gas inlet and a second gas inlet wherein the gas enters the vessel through the at least one first gas inlet with a velocity of from about 10 l/s to about 70 l/s the said gas is added to the vessel through the at least one first gas inlet and the second gas inlet is at a combined rate of from about 1 m/s to about 155 m/s;

(c) concurrently with (b), mechanically agitating the fabric while the gas impinges on soiled areas of the fabric; and (d) concurrently with (b) and (c) removing the gas from the vessel at a rate sufficient to prevent the removed soil from re-depositing upon the fabric;

In accordance with a fourth aspect of the present invention, an apparatus for removing particulate soil from discrete fabric articles by mechanically agitating the fabric while gas impinges on soiled areas of the fabric is provided. The apparatus comprises a rotary drum driven by an electric motor under the control of a control means, at least one first gas inlet, wherein the at least one first gas inlet has a muzzle diameter sufficient to provide gas to the apparatus at a muzzle velocity of from about 1 m/s to about 155 m/s a second gas inlet, wherein the at least one first gas inlet and the second gas inlet provide gas to the apparatus at a rate of from about 10 l/s to about 70 l/s and at least one gas outlet, wherein the gas outlet is of sufficient diameter to prevent the removed soil from re-depositing upon the fabric.

These and other aspects, features and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All measurements are in SI units unless otherwise specified. All documents cited are in relevant part, incorporated herein by reference.

DETAILED DESCRIPTION OF THE INVENTION

Definitions

Particulate soil: the term particulate soil used herein is intended to mean any soil that is comprised of discrete particles. For example this would include, clay, dust, dried mud, sand. Also included in the meaning of the term particulate soil are discrete particles such as, cat fur, skin flakes or scales, dander, dandruff, hair from people or pets, grass seeds, pollen, burrs, and/or similar animal, mineral or vegetable matter which is insoluble in water.

Fabric Articles: the term fabric articles used herein is meant to mean one or more articles which includes, but is not limited to, articles of clothing, such as, hats, socks, pants, skirts, kilts, gloves, coats, shirts, intimate apparel, etc.; linen, such as sheets, towels, donnas, quilts, blankets, sleeping bags, etc.; drapery, such as curtains, tapestries; and floor coverings, such as, rugs, mats, etc. It also includes these articles made of any fabric material such as, natural, for example, cotton, wool, silk; man-made fibers, such as, polyester, RAYON, DACRON; and blends, such as poly-cotton blends.

Figure 1:
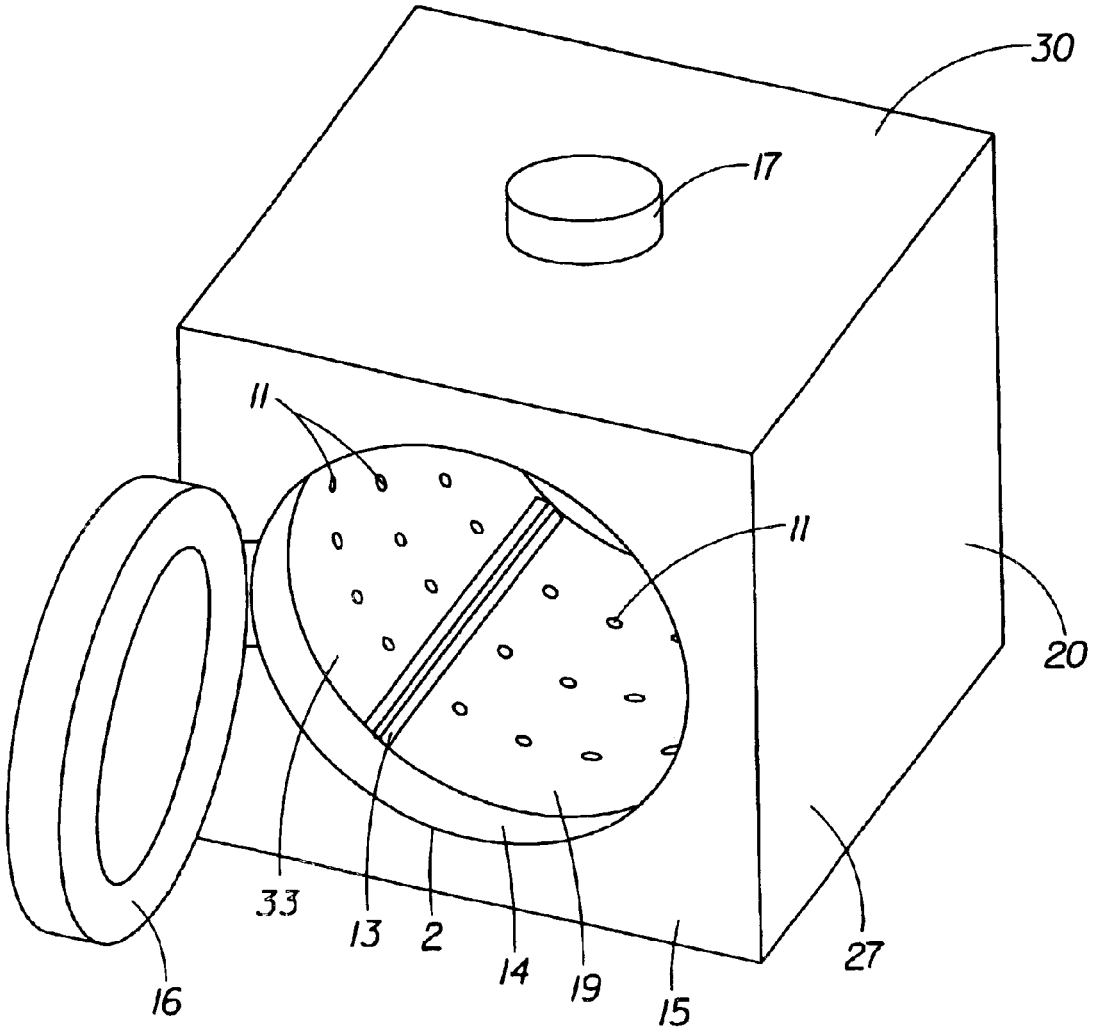
FIG. 1 is a perspective view of an apparatus in accordance with one embodiment of this invention.

FIG. 1 shows a perspective view of one possible embodiment of the apparatus 1 of the present invention. The apparatus 1 includes a cabinet or main housing 20 having a front panel 15, a rear panel 26 (not shown) and a pair of side panels 27 (not shown) and 28 (not shown) spaced apart from each other by the front and rear panels, a bottom panel 29 (not shown) and a top cover 30. The front panel 15, rear panel 26, side panels 27 and 28, bottom panel 29 and top panel 30 are arranged such that an interior volume is defined. The front panel 15 comprises a door 16, and a door opening 16' allowing for addition and removal of fabric articles to the apparatus. On top of the apparatus and passing through top cover 30, and being in communication with the imperforate outer cylinder 32, is an gas duct 17 that permits gases to travel from the interior cylinder 19, through the plurality of holes 11 therein and from the outer drum 32 through the gas duct 17 away from the housing 20. Within the housing 20, is a drum 31, containing an inner cylinder 19, which is mounted for rotation around a substantially horizontal axis and an imperforate outer cylinder 32 (not shown). The drum 31, is generally cylindrical in shape, having an imperforate outer cylinder 32 (not shown), and a front flange or wall 14, defining an opening 33, to the drum 31. The inner drum includes a rear wall 34, rotatably supported within the main housing 20, by suitable fixed bearing. The inner drum includes a plurality of holes or perforations 11 that receives the gas and removed particulate soil after it has contacted the soiled fabric. The gas is supplied to the apparatus by way of the gas nozzles 2, located on the front flange 14. These nozzles 2, can direct gas at angles ranging from substantially parallel to the axis of horizontal rotation of the inner cylinder 19, to approximately 60° to the axis of horizontal rotation of the inner cylinder 19. Fabric articles are loaded in to the inner cylinder 19, through the opening 33. A plurality of drum baffles, 13 (only one shown), are provided within the drum to lift the fabric articles and then allow them to tumble back to the bottom of the inner cylinder 19 as the inner cylinder rotates. Concurrent with the tumbling of the fabric articles a gas is supplied to the inner cylinder via the gas nozzles 2, striking the particulate soil on the fabric articles. The gas and removed particulate soil is removed from the inner cylinder 19, to the outer cylinder 32, (not shown). The particulate soil and gas mixture is removed from the outer cylinder 32, (not shown), by way of the air duct 17. Some particulate soil is not removed from the outer cylinder 32, (not shown), by way of the air duct 17, instead it is collected in a bottom filter or capture means 4, (not shown).

Figure 2:
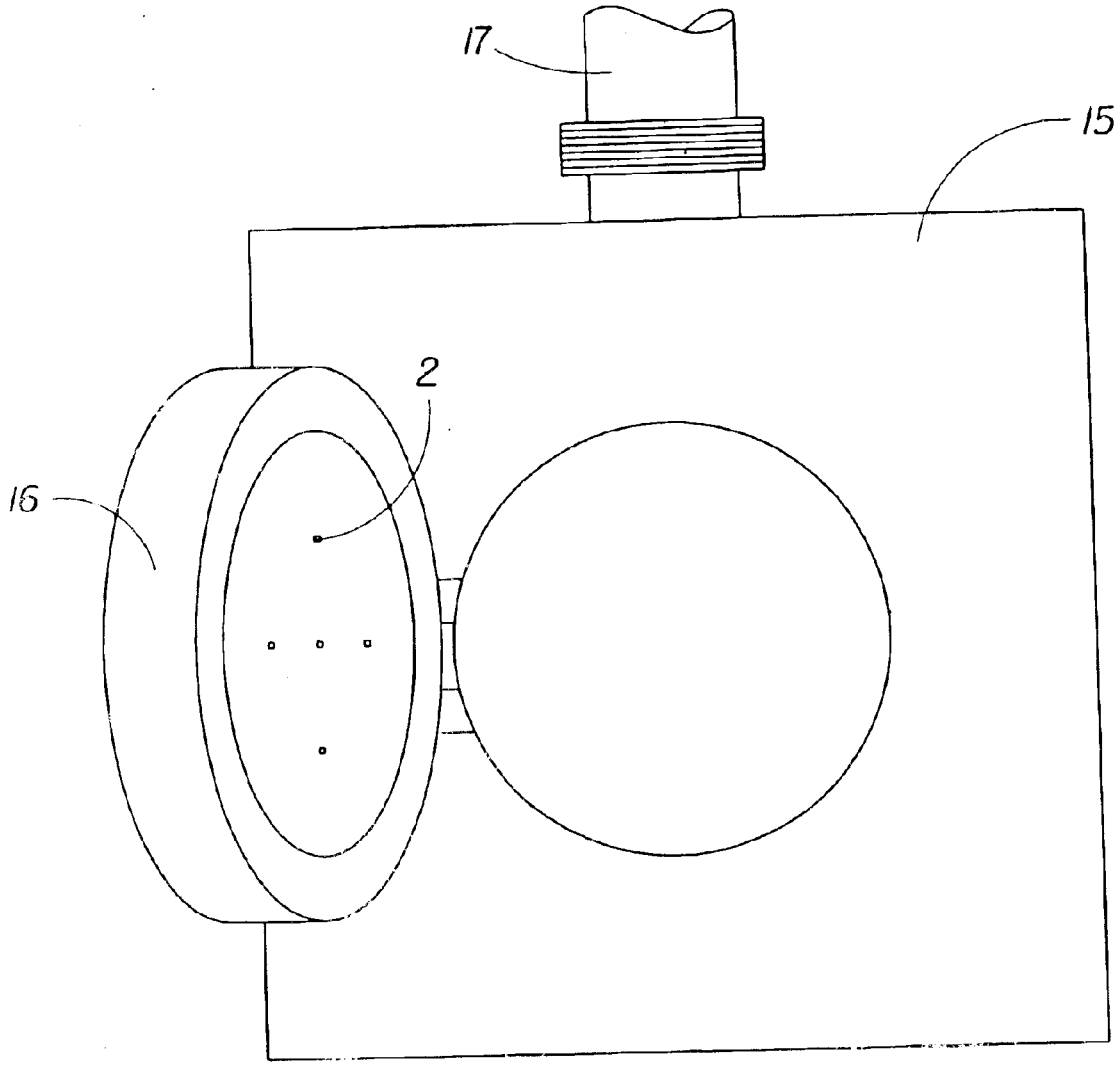
FIG. 2 is a perspective view of an apparatus in accordance with one embodiment of this invention.

FIG. 2 shows a front view of another possible embodiment of the apparatus of the present invention. The apparatus is similar to the apparatus illustrated in FIG. 1 except that the gas is supplied to the apparatus by way of the gas nozzles 2, located on the door 16. These nozzles 2, can direct gas at angles ranging from substantially parallel to the axis of horizontal rotation of the inner cylinder 19, (not shown), to approximately 60° to the axis of horizontal rotation of the inner cylinder 19 (not shown). The apparatus is utilized to remove particulate soil from fabric articles in a manner similar to the apparatus illustrated in FIG. 1. With the gas and some of the particulate soil exiting the apparatus through gas vent 17.

Figure 3:
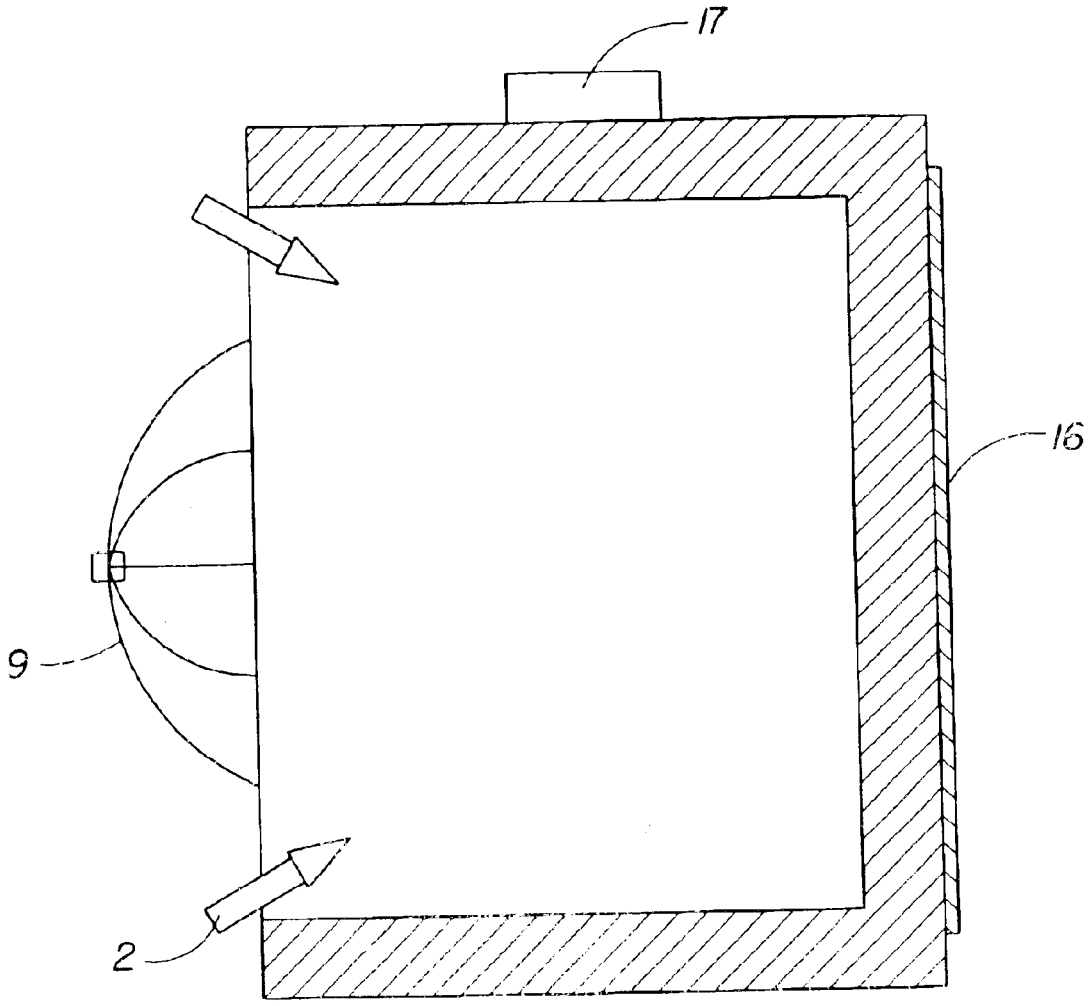
FIG. 3 is a sectional view of an apparatus in accordance with one embodiment of this invention.

FIG. 3 shows a cut away side view of another possible embodiment of the apparatus of the present invention. The apparatus is similar to the apparatus illustrated in FIG. 1 except that in this illustration the gas nozzles 2, are located on the outer cylinder 32, opposite the opening to the drum, 33 and the door, 16. The gas nozzles 2, are at an angle of approximately 60° to the axis of rotation of the inner cylinder 19. The gas nozzles 2, direct gas into the inner cylinder 19, and on to the soil on any fabric article present therein. The apparatus is utilized to remove particulate soil from fabric articles in a manner similar to the apparatus illustrated in FIG. 1. However, unlike the apparatus illustrated in FIG. 1, the gas and particulate soil leaving the inner drum through an openings, 24, (not shown), in the rear wall of the inner drum 34 (not shown). The gas and some of the particulate soil exiting the apparatus through gas vent 17, while the remainder of the particulate soil is captured in the bottom filter or capture means 4, (not shown).

Figure 4:
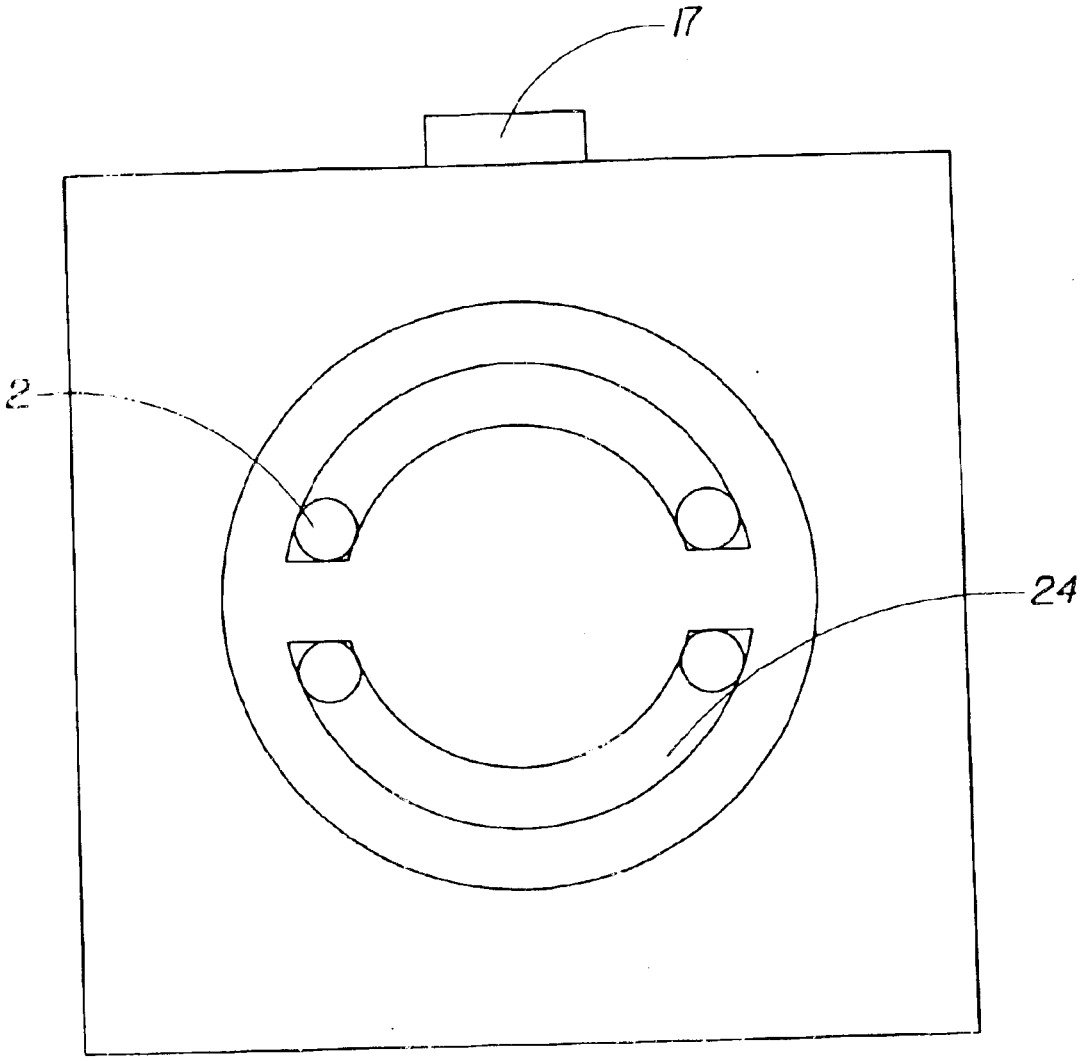
FIG. 4 is a plan view of the apparatus of FIG. 3.

FIG. 4 shows a cut away rear view of the apparatus illustrated in FIG. 3. The location of the gas nozzles, 2 is shown relative to the openings, 24, in the rear wall of the inner drum 34.

Figure 5:
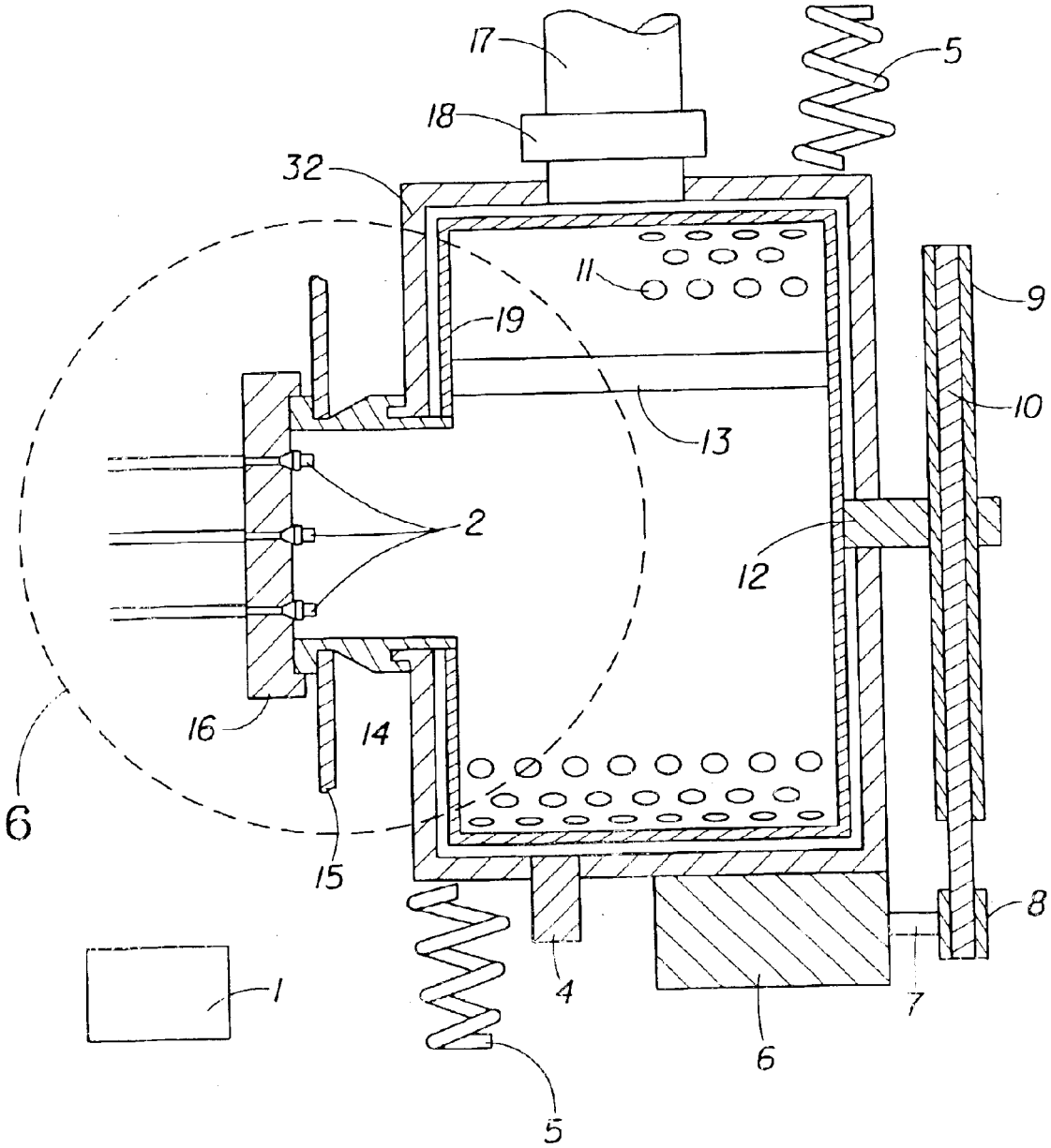
FIG. 5 is sectional view from the side of the apparatus of FIG. 2.

FIG. 5 shows a cut away view of the embodiment of the present invention illustrated in FIG. 2. A variable speed motor 6, with a drive shaft 7, and motor shaft pulley 8, are connected to a drum pulley 9, through a driving belt, 10. When the motor 6 rotates the drum pulley 9, it causes the inner drum, 19 to rotate around the drum shaft 12. The soil removed from the fabric passes through the perforations 11, in the inner drum 19, to the outer drum 32. Rotation of the inner drum 19, helps convey the soil between inner drum 19 and outer drum 32. The gas and some of the particulate soil, especially the lighter particulate soil, moves from outer drum 32 to the gas vent 17 first passes through a filter capture device 18, which removes substantially all of the particulate soil from the gas before it leaves the apparatus through the gas vent 17. The remainder of the particulate soil, especially the heavier soil is collected in the bottom filter or capture means 4. Shock absorbers 5, are connected from the outer drum 32, to the main housing 20. The shock absorbers 5, dampen any torque that may arise from the rotation of the inner drum 19 especially where it contains soiled fabric articles. The shock absorbers 5, will prevent any movement of the apparatus over the surface on which it is located caused by the rotation of the inner drum 19. The gas is supplied to gas nozzles 2, through a gas line 35, from a gas source 1. The gas source may be a variety of suitable sources of gas. For example the gas source 1, may be an air compressor, or gas in pressurized containers. Further information on suitable gas sources, such as air compressors, is included herein below.

Figure 6:
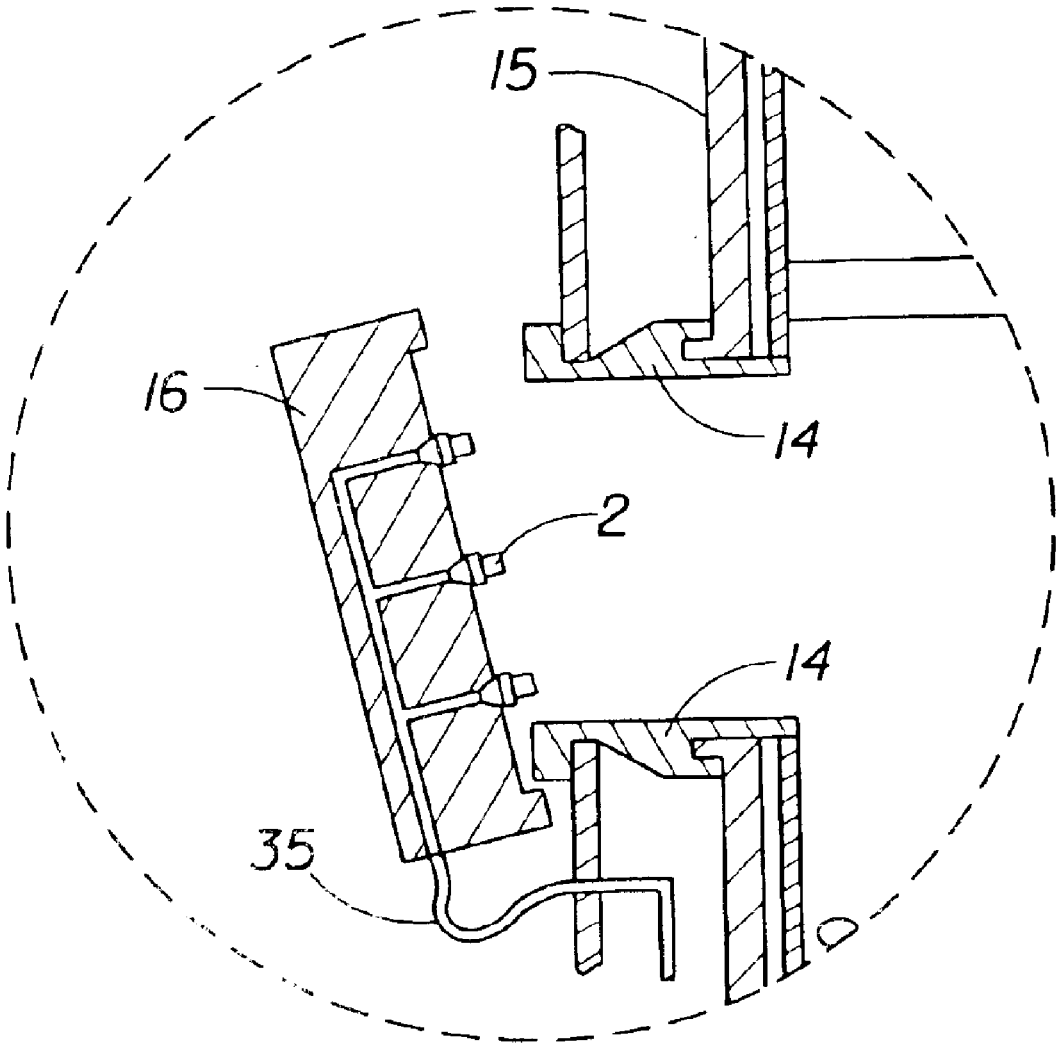
FIG. 6 is sectional view from the top of the apparatus of FIG. 2.

FIG. 6 shows a cut away view of one possible embodiment of the present invention when the gas is delivered to the apparatus through the door. The gas nozzles 2 are situated in door 16, which is attached to the front panel 15 of the apparatus through hinge 36. The gas nozzles 2 are connected to the gas source 1, (not shown) through gas lines 35.

Figure 7:
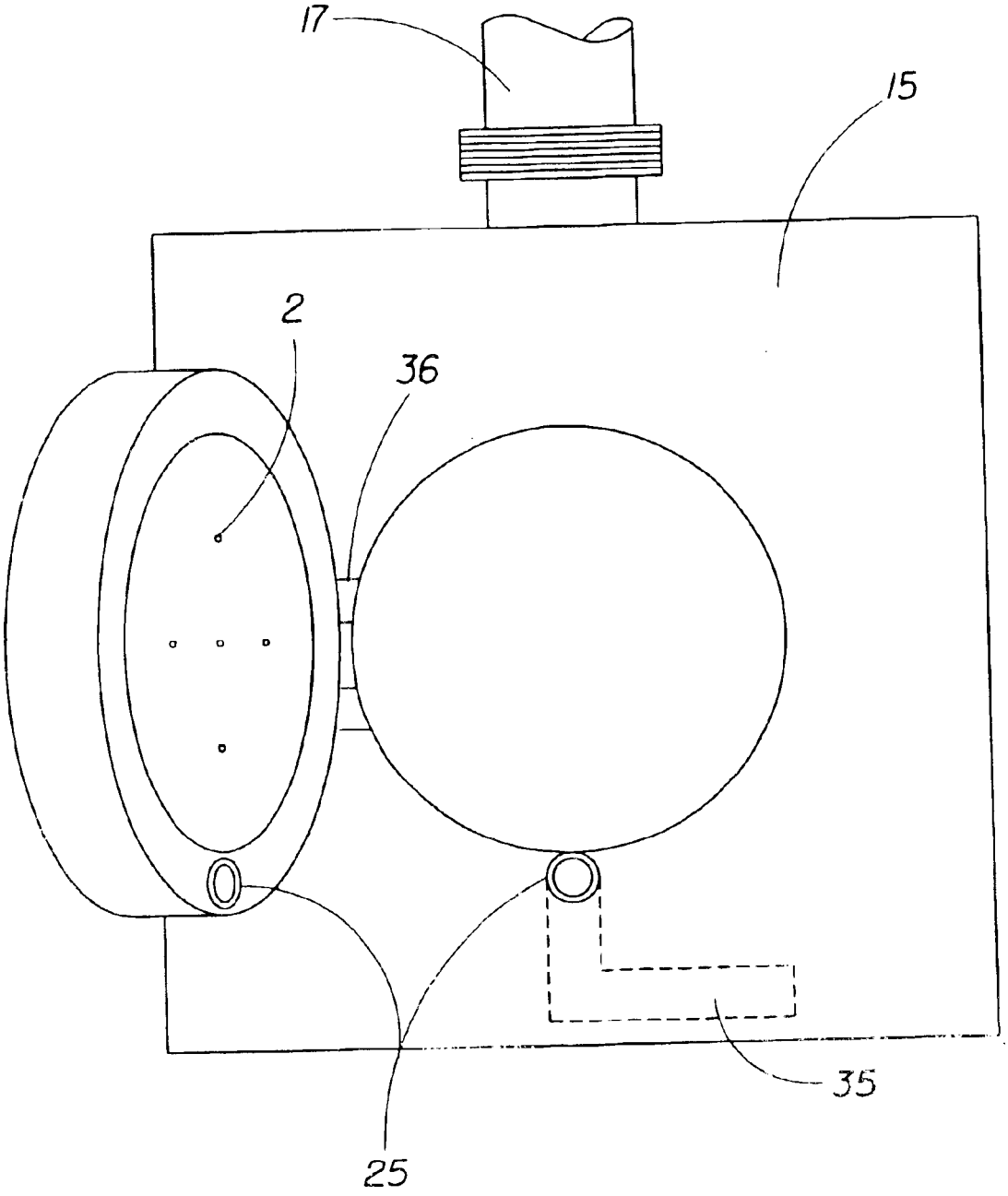
FIG. 7 is a front view of an apparatus in accordance with one embodiment of this invention.

FIG. 7 shows a front view of another possible embodiment of the present invention when the gas is delivered to the apparatus through the door, with the door open. The gas nozzles 2 are situated in door 16, which is attached to the front panel 15 of the apparatus through hinge 36 (not shown). The gas nozzles 2 are connected to the gas source 1, (not shown) through gas lines 35 and air flow coupling devices 25.

Figure 8:
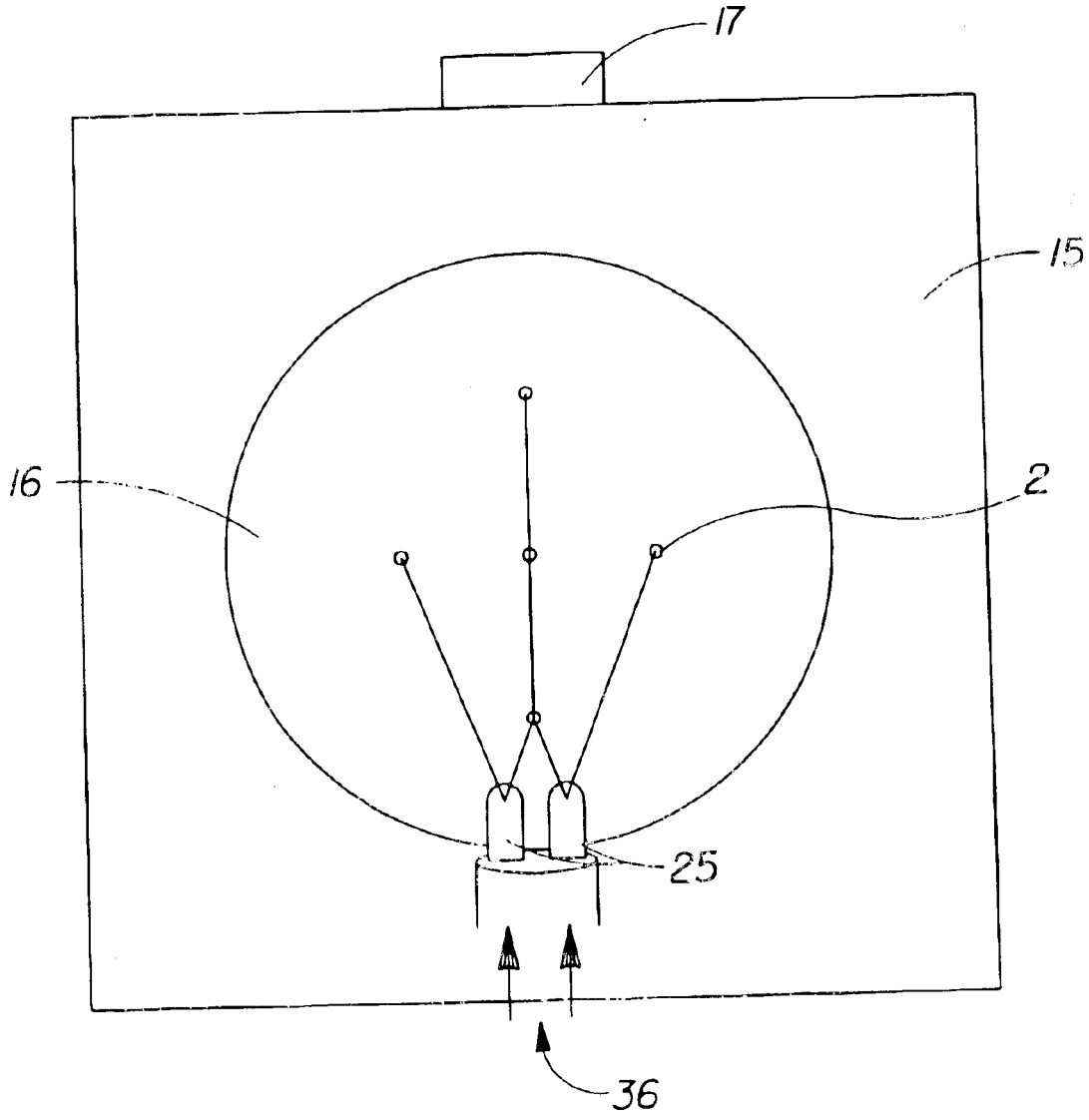
FIG. 8 is a front cut away view of the apparatus of FIG. 7.

FIG. 8 Shows a partial cut away front view of the apparatus illustrated in FIG. 7 with the door closed. When door 16 is closed, the air flow coupling devices 25, allow the gas or gasses from the gas source 1, (not shown), through the gas lines 35 to the gas nozzles 2 without the loss of any gas, or any reduction in velocity or flow rate of the gas.

Figure 9:
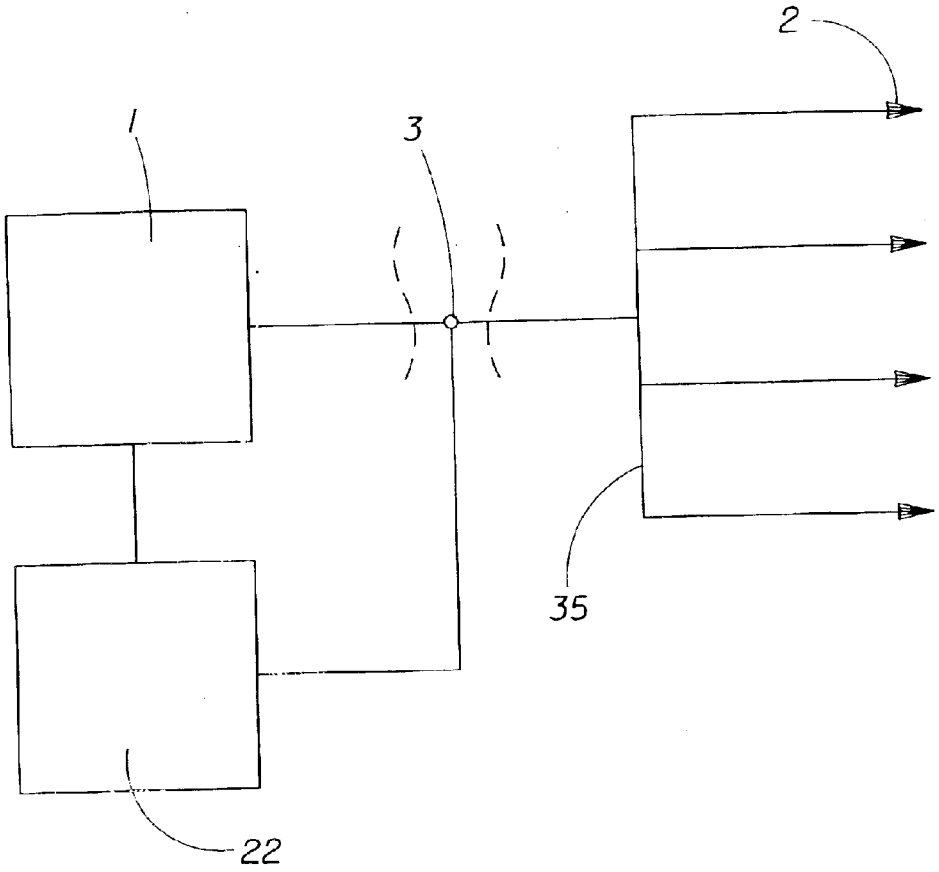
FIG. 9 shows one embodiment of the present invention in which the gas is ionized prior to entering the vessel.

FIG. 9 is a diagram illustrating one embodiment for ionizing the gas before it impinges on the particulate soil on the fabric articles. The gas flows from the gas source 1, through the gas lines 35, past a high voltage electrode 3, which is connected to a high voltage source 22, to the gas nozzles 2. The high voltage electrode 3 discharges into the gas flowing to the gas nozzles 2, through the gas lines 35 and then into the inner drum 19, (not shown) impinging on the particulate soil on the fabric articles and thereby removing the particulate soil. Alternatively, the instead of ionizing the gas, when the gas is all or at least part oxygen the high voltage electrode 3, can be used to convert any or all of the oxygen in the gas into ozone.

Figure 10:
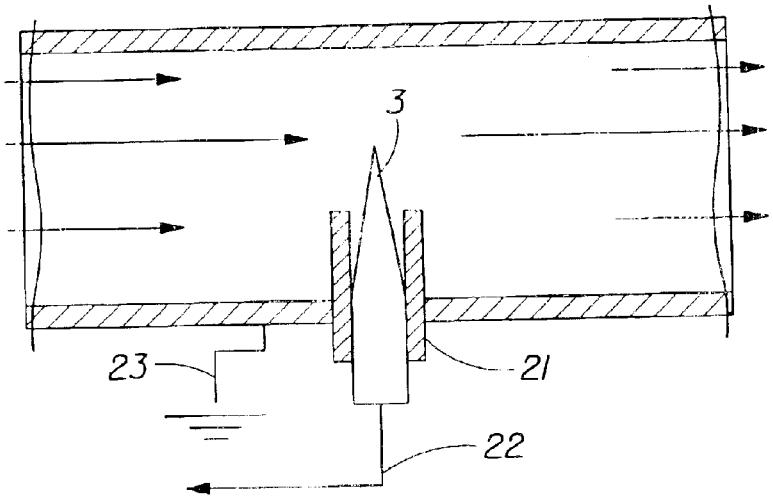
FIG. 10 shows a cut away view of the ionizer used in the embodiment illustrated in FIG. 9.

FIG. 10 is a cut away view of the section of the gas line near the high voltage electrode. The high voltage electrode 3, is electrically isolated from the gas line 35, by an insulator 21. The gas line 35 is also grounded 23 to allow the electrode to discharge into the gas flowing in the gas line 35.

Figure 11:
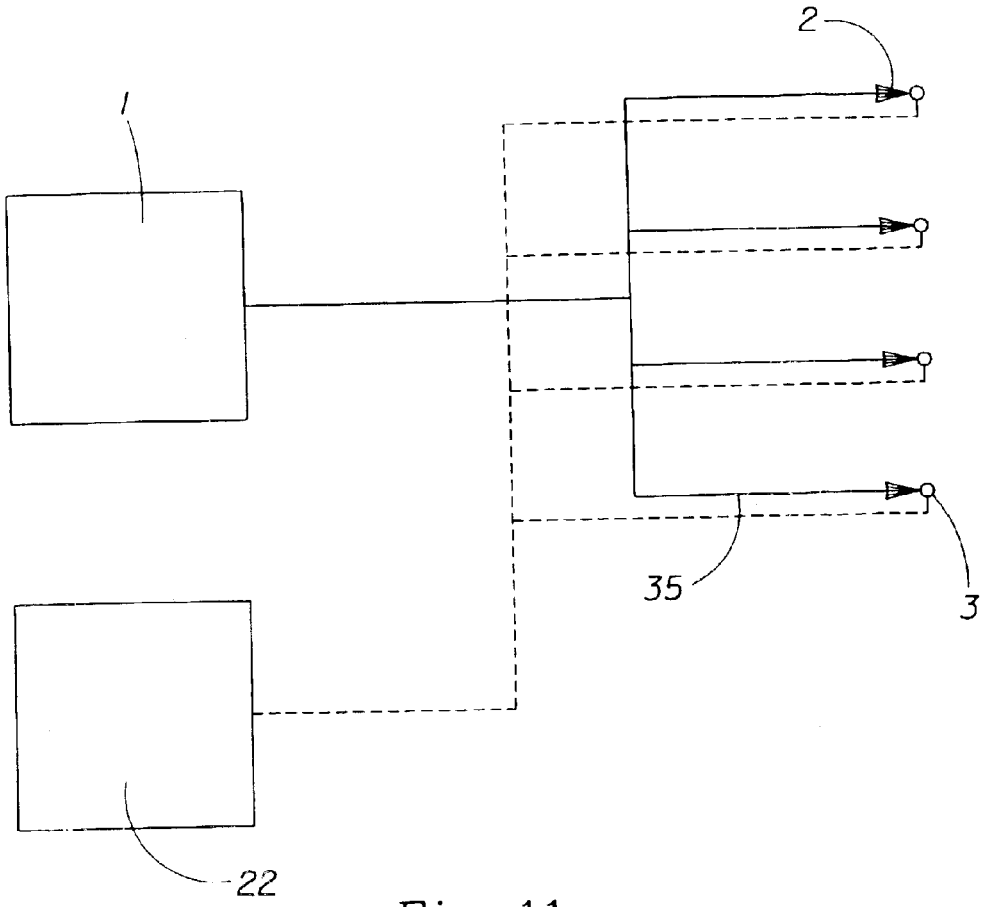
FIG. 11 shows one embodiment of the present invention in which the gas is ionized upon to entering the vessel

FIG. 11 is a diagram illustrating another embodiment for ionizing the gas before it impinges on the particulate soil on the fabric articles. The gas flows from the gas source 1, through the gas lines 35, past a high voltage electrode 3, which is connected to a high voltage source 22, located immediately next to the gas nozzles 2. The high voltage electrode 3 discharges into the gas flowing immediately to the gas nozzles 2 and then into the inner drum 19, (not shown) impinging on the particulate soil on the fabric articles and thereby removing the particulate soil. Alternatively, the instead of ionizing the gas, when the gas is all or at least part oxygen the high voltage electrode 3, can be used to convert any or all of the oxygen in the gas into ozone.

Figure 12:
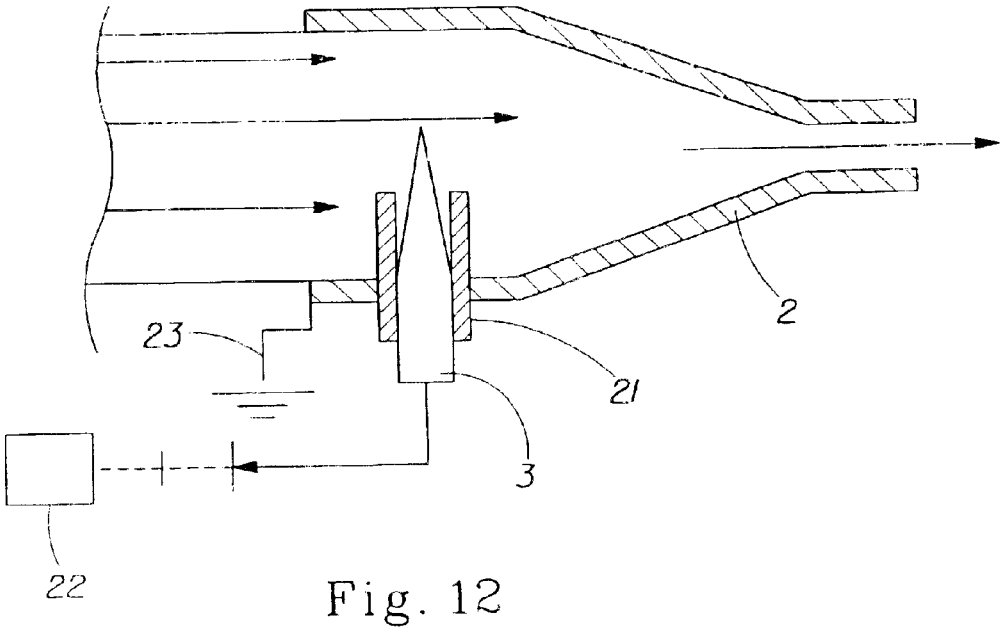
FIG. 12 is shows a cut away view of the ionizer used in the embodiment illustrated in FIG. 11.

FIG. 12 is a cut away view of the section of the gas line near the high voltage electrode. The high voltage electrode 3, is electrically isolated from the gas line 35, by an insulator 21. The gas line 35 is also grounded 23 to allow the electrode to discharge into the gas flowing in the gas line 35.

Figure 13:
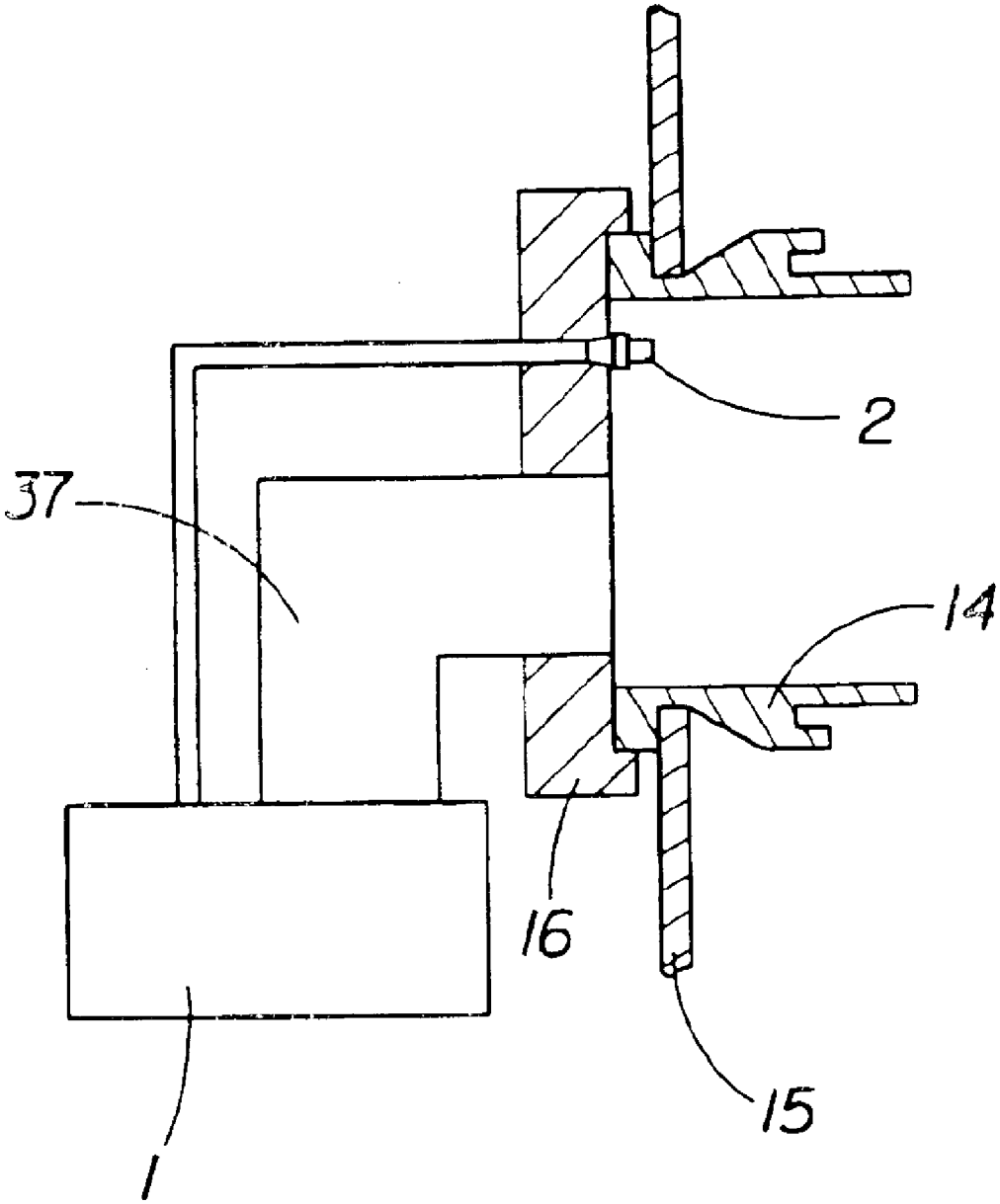
FIG. 13 is a sectional view of an apparatus in accordance with one embodiment of this invention.

FIG. 13 shows a cut away view of one possible embodiment of the present invention when the gas is delivered to the apparatus through the door two nozzles of different size. The gas is delivered to the inner drum 19, through two different diameters. The smaller of the two gas nozzles illustrated, gas nozzle 2, delivers the gas at a velocity sufficient to remove the particulate soil from the fabric articles. The larger of the two gas nozzles illustrated, gas nozzle 37, delivers sufficient gas to the in inner drum 19, in combination with gas nozzle 2, to meet the essential gas flow requirements of the present invention.

The Vessel or Apparatus

In one aspect of this embodiment of the present invention the vessel is a modified tumble dryer. The modifications would include at the least one means for delivery of the gas into the vessel at the essential flow rate and velocity, and means for preventing the removed soil from re-depositing upon the fabric. Similarly, horizontal axis washers, dryers and washer dryers could be modified to be used as the vessels for the processes or the apparatus of the present invention. It is one aspect of this embodiment of this aspect of the present invention that any such modified washers and washer dryers retain the ability to wash and/or dry clothes as they did before modification. For example this could mean that the method of the present invention could be included as an additional cycle on a washing machine.

In another aspect of this embodiment of the present invention the vessel or apparatus is built in such a manner so to only conduct the process of the present invention.

In one embodiment of the present invention the apparatus may optionally include one or more electrostatic-generators. These are illustrated in FIGS. 9 to 12 inclusive. These can either be located before the gas enters where the fabric is agitated, as illustrated in FIGS. 9 and 10, or can be located where the fabric is agitated, as illustrated in FIGS. 11 and 12.

In one embodiment of the present invention the apparatus may deliver the gas by way of one or more nozzles to the area where the fabric is mechanically agitated. More preferably, at least two nozzles are used, even more preferably the gas is delivered to the area where the fabric is by from 3 to 20 nozzles. The nozzles will have a diameter, which is sufficient to ensure that the essential gas flow and velocity requirements are met. Preferably the nozzles will have a diameter from about 1.5 mm to about 10 mm, more preferably from 3 mm to about 5 mm. The nozzles can be made of any suitable material, such as steel, brass, plastic or other suitable alloys or plastics. Illustrative placement of the nozzles can be found in FIGS. 1 and 2. The diameters being measured at the end of the nozzle which the gas exits from and enters the area of the vessel or apparatus where the clothes are agitated.

In an alternative embodiment of the present invention, there are included two types of gas sources or inlet, a first gas source or inlet and a second gas source or inlet. The first gas source or inlet provides gas at a velocity of from about 1 m/s to 155 m/s, and combined the first and second gas sources or inlets provide gas to the vessel or apparatus at a flow rate of from about 10 l/s to about 70 l/s. Preferably there are at least two first gas source or inlet and only one second gas source or inlet. It is also preferred that the second gas source or inlet have larger in diameter than each individual first gas source or inlet, more preferably that each first gas source or inlet has a diameter of from about 1.5 mm to about 10 mm and the second gas source or inlet has a diameter of from about 50 mm to about 150 mm, even more preferably the second gas source or inlet has a diameter of from about 50 mm to about 70 mm. While it is preferred that the gas source or inlet are circular the gas source or inlet may be of any shape which will deliver the gas at the appropriate velocity and flow rate.

In one aspect of this embodiment of the present invention the nozzles present in an apparatus, which provides agitation via means of a rotating horizontal drum, may be arranged parallel to the axis of rotation. An example of such an arrangement of nozzles may be found in FIGS. 2 and 5. In another aspect of this embodiment of the present invention the nozzles may be arranged other than parallel to the axis of rotation. An example of such an arrangement of nozzles may be found in FIG. 3.

The vessel used in the process and the apparatus of the present invention will typically contain some type of control system. These include electrical systems, such as the so-called smart control systems, as well as more traditional electromechanical systems. The control systems would enable the user to select the size of the fabric load to be cleaned, the type of soiling, the extent of the soiling, the time for the cleaning cycle. Alternatively, the user could use pre-set cleaning and/or refreshing cycles, or the apparatus could control the length of the cycle, based on any number of ascertainable parameters. This would be especially true for electrical control systems. For example, when the collection rate of particulate matter reaches a steady rate the apparatus could turn its self of after a fixed period of time.

In the case of electrical control systems, one option is to make the control device a so-called "smart device". This could mean including, but not limited to, self diagnostic system, load type and cycle selection, linking the machine to the Internet and allowing for the consumer to start the apparatus remotely, be informed when the apparatus has cleaned a garment, or for the supplier to remotely diagnose problems if the apparatus should break down. Furthermore, if the removal of the particulate soil was only the first part of a cleaning system, the so called "smart system" could be communicating with the other cleaning devices which would be used to complete the remainder of the cleaning process, such as a washing machine, and a dryer.

Agitation means—In one embodiment of the present invention the agitation of step (c) is provided by mechanical means. One preferred mechanical means of agitating of step (c) is provided by tumbling the fabric in a horizontal drum. The horizontal drum being rotated at less than one gravity is and this allows for the free tumbling of the fabrics. Preferably the rotation is from about 0.5G to 0.9G. The actual rotation speed required to reach these forces will depend upon the size and diameter of the particular drum.

The rotation speed required of a particular drum can be calculated using the following formula $$v = \frac{2\pi r}{t}$$

Where r is the radius of the drum;

t is the time in minutes of one revolution;

v is the velocity of rotation;

$a_c$ is the centripetal acceleration;

g is 9.8 $m/s^{-2}$ (acceleration of earth's gravity); and $F_g$ is the G force.

For example a drum with a radius of 10.5" would need to be rotated at 40 revolutions per minute (rpm) to generate a force of 0.5G. Rotating the same drum at 55 rpm would generate a force of 0.9 G. These examples are provided as purely illustrative and should be in no means construed as limiting of the scope of the present invention.

The drum may be any shape that will allow for free tumbling of fabrics. This includes, but is not limited to cylinders with both flat sides and traditional round-sided cylinders. The drums can be made of any suitable material. For example suitable material includes aluminium, stainless steel, polymeric material and combinations thereof. The drums may optionally be perforated, with holes in its surface, it may contain no such perforations holes, it may contain holes at one end and none on the side of the drum, or it may be an open ended cylinder with no holes on the side of the drum and one end covered with a mesh or other suitable material which will retain the fabric articles while allowing the gas and particulate soil to pass through. The shape and area of any such perforations would be such to maximize air flow while minimizing the potential for garments to be entangled in them of for buttons or the like to become entrapped in the holes. The drum may have a uniformly even surface internally, however, it they may also have a variety of raised or recesses sections, more preferably raised, on the internal surface of the drum. Such raised sections would include ridges or bumps regularly placed on the internal surface of the drum. Such a regular placement is highly desired as it aids in the rotation of the drum. These ridges or bumps may optionally run the length of the drum. An illustrative example of such a drum can be found in FIGS. 1 and 5.

In one embodiment of the present invention brushes may be optionally attached to the walls of the drum to provide additional rubbing, thus increasing the removal of large particulates from the fabrics. Optionally spherical objects, such as, tennis balls or the like may be optionally placed in the to the drum, to create additional capacity for "knocking" the particulates off the fabrics.

Gas

In one embodiment of the present invention the gas is selected from the group consisting of air, nitrogen, ozone, oxygen, argon, helium, neon, xenon, and mixtures thereof, more preferably air, nitrogen, ozone, oxygen, argon, helium, and mixtures thereof, even more preferably still air, ozone, nitrogen, and mixtures thereof.

In another aspect of this embodiment of the present invention the gas used in the method can be varied over time. For example air could be used at the start of the process, a mixture of air and ozone used in the middle stages of the process and air or nitrogen could be used at the end.

The gas used may be of any suitable temperature or humidity. Heat could be supplied to the gas electrically or by passing the gas over a gas flame, such as, is done in a conventional gas dryer. However, room temperature and humidity gas are preferred.

In one embodiment of the present invention two or more gases could be mixed in a mixing chamber before being used in the process. In another aspect of this embodiment of the present invention the gases could be delivered concurrently through different entry points and mix in-situ in the walled vessel. In another aspect of this embodiment of the present invention the gases supplied could exist as mixture and would not require any mixing chamber to achieve the required mixture of gas for the process.

In one embodiment of the present invention the gas could be available from storage, such as from pressurized containers. Alternatively, the gas used in the process could be obtained from the location where the process and device occur. For example, a pump, blower, or the like, may be used to supply air from the surrounding atmosphere for the process of the invention. A combination of gas available from storage and from the atmosphere is also envisioned.

In another embodiment of the present invention the gas can be obtained from a compressor. The compressor may be any compressor suitable for providing gas or gases, provided that they supply the gas to the apparatus within the required velocity and flow rate ranges. The compressors are linked to the gas inlet(s) by an appropriate fixture, such as a hose, pipe, tap, fixture or combinations thereof, to provide the inlet(s) with the gas or gases within the required velocity and flow rate ranges. Some typical compressors, which are suitable for providing gas or gases, include rotary screw compressors or two-stage electrical compressor. Another suitable type of compressor is the so-called "acoustical compressor", such as those described in U.S. Pat. Nos. 5,020,977, 5,051,066, 5,167,124, 5,319,938, 5,515,684, 5,231,337, and 5,357,757, all of which are incorporated herein by reference. Typically, an acoustical compressor operates in the following fashion: A gas is drawn into a pulse chamber, such as air from the atmosphere, compressed, and then discharged as a high-pressure gas. The gas is compressed by the compressor sweeping a localized region of electromagnetic, for example microwaves, laser, infrared, radio etc., or ultrasonic energy through the gas in the pulse chamber at the speed of sound. This sweeping of the pulse chamber creates and maintain a high-pressure acoustic pulse in the gas. These acoustical compressors have many advantages over conventional compressors. For example, they have no moving parts besides the valves, operate without oil, and are much smaller than comparable conventional compressors.

In one embodiment of the present invention the gas is added to the vessel at a rate of from about 10 l/s to about 70 l/s, more preferably, about 20 l/s to about 42 l/s, even more preferably about 25 l/s to about 30 l/s. The gas flow rate is measure by a flow meter place in the internal space of the vessel close to where the gas enters the vessel containing the clothes.

In one embodiment of the present invention the gas enters the vessel with a velocity of from about 1 m/s to about 155 m/s, more preferably, about 50 m/s to about 105 m/s even more preferably about 75 m/s to about 105 m/s. The gas velocity is measure by a flow meter place in the internal space of the vessel close to where the gas enters the vessel containing the clothes. It is a key aspect of the present invention that the fabric be mechanically agitated.

The velocity at which the gas enters the vessel and the flow rate of the gas are critical parameters. For example insufficient velocity, means that the particulates are not removed from the fabric. Too great a velocity and the garments are trapped against the opposite to the gas entry point, unable to be agitated and again the particulates are not removed. Similarly, insufficient flow rate of the gas means that any particulates removed remain and can be redeposited on the fabric after cleaning. It is an essential feature of this invention that the fabric is mechanically agitated in the presence of a gas that has a flow rate of from about 10 m/s to about 70 l/s and enters the vessel with a velocity of from about 1 m/s to about 155 m/s.

Preferably, outgoing gas flow is slightly higher than incoming gas flow, so the slight negative pressure is created inside the drum to help vent the particles out. It is also one possible embodiment of the present invention to use a device such as an extraction fan, pump or the like in the gas vent to aid in the removal of the particulate laden soil from vessel.

For more complex soils such as dried mud, higher air velocities are required coupled with higher number of openings.

Removal of particulate soil

Once the particulate soil is removed from the fabric it is then removed from the vessel at a rate sufficient to prevent it from re distributing upon the fabric. This removal can be obtained in many and varied ways. In one aspect of this embodiment of the present invention the particulate soil is removed from the vessel by the gas. The gas carrying the particulate soil may optionally pass through a device that will remove the particulate soil. Such devices typically include, filters, cyclones, electrostatic filters and the like. These could be disposable or reusable and be regenerated for use by simple mechanical removal of the particulate soil or by rinsing with water. These devices may be part of an exhaust system, which removes the gas from the vessel, removes the particulate soil by some means from the gas, and then exits the apparatus via an exhaust vent or vents. This is arrangement would be analogous to the lint filter or trap which is used in conventional dryers. Alternatively, the gas could be recycled once the particulate soil had been removed and reused in the process.

Having thus described the invention in detail, it will be apparent to those skilled in the art that various changes may be made without departing from the scope of the invention and the invention is not to be considered limited to what is described in the specification.

What is claimed is:

1. A method for refreshing and removing particulate soil from discrete fabric articles in an apparatus comprising a rotary drum driven by a motor under the control of a control means, at least one gas inlet, wherein said gas inlet has a muzzle diameter sufficient to provide gas to said apparatus at a combined rate of from 10 m/s to 70 m/s and a muzzle velocity of from 1 m/s to 155 m/s, and at least one gas outlet, wherein said gas outlet is of sufficient diameter to prevent the removed soil from re-depositing upon said fabric; said method comprising the steps of:

(a) placing substantially dry fabric articles into said rotary drum;

(b) adding a gas to said rotary drum through said at least one gas inlet;

(c) concurrently with (b), mechanically agitating said fabric while said gas impinges on soiled areas of said fabric; and (d) concurrently with (b) and (c) removing said gas from said rotary drum.

2. A method according to claim 1 wherein said agitation of step (c) is provided by tumbling said fabric in said rotary drum by rotating said rotary drum at less than about one gravity.

3. A method according to claim 1 wherein said agitation of step (c) is provided by tumbling said fabric in said rotary drum by rotating said rotary drum at from about 0.5 gravity to about 0.9 gravity.

4. A method according to claim 1 further comprising the step of:

(e) laundering or dry cleaning said discrete fabric articles.

5. A method according to claim 1 wherein said rotary drum is horizontally oriented.

6. A method according to claim 1 wherein said apparatus has from at least about 3 to at most about 20 said at least one gas inlet.

7. A method according to claim 1 wherein said apparatus further comprises an electrostatic generator.

8. A method according to claim 7 wherein said gas passes through said electrostatic generator prior to passing through said gas inlets.

9. A method according to claim 1 wherein said apparatus further comprises an acoustical compressor under the control of said control means.

10. A method according to claim 9 wherein said gas passes through said acoustical compressor prior to passing through at least one of said gas inlets.

11. A method according to claim 1 wherein said gas inlets are substantially parallel to the axis of rotation of said rotary drum.

12. A method according to claim 1 wherein said gas outlet comprises a filter for separating said particulate soil from said gas.

13. A method according to claim 12 wherein said filter is selected from the group consisting essentially of screen filters, and disposable filters.

14. A method according to claim 1 further comprising a vacuum means for removing said gas through said gas outlet.

15. A method according to claim 1 wherein said apparatus is a modified apparatus selected from the group consisting essentially of front loading washing machines, tumble dryers, and dry cleaning washing machines.

16. A method according to claim 1 wherein at least one gas inlet has a diameter smaller than the diameter of at least one other gas inlet.

17. A method according to claim 1 wherein at least one gas inlet has a diameter of from about 1.5 mm to about 10 mm.

18. A method according to claim 1 wherein at least one gas inlet has a diameter of from about 3 mm to 5 mm and at least one other gas inlet has a diameter of from 50 mm to 150 mm.

19. A method according to claim 1 wherein said gas is selected from the group consisting essentially of of air, nitrogen, ozone, oxygen, argon, helium, neon, xenon, partially ionized air, partially ionized nitrogen, partially ionized ozone, partially ionized oxygen, partially ionized argon, partially ionized helium, partially ionized neon, partially ionized xenon, and mixtures thereof.

20. A method according to claim 1 wherein said gas is added to said vessel at a rate of from about 20 l/s to about 42 l/s.

21. A method according to claim 1 wherein said gas is added to said vessel at a rate of from about 25 m/s to about 30 m/s.

22. A method according to claim 1 wherein said gas enters said vessel with a muzzle velocity of from about 50 m/s to about 105 m/s.

23. A method according to claim 1 wherein said gas enters said vessel with a muzzle velocity of from about 75 m/s to about 105 m/s.

* * * * *